US009315066B2

(12) United States Patent
Niemeyer et al.

(10) Patent No.: US 9,315,066 B2
(45) Date of Patent: Apr. 19, 2016

(54) WRITING IMPLEMENT

(71) Applicant: Montblanc-Simplo GmbH, Hamburg (DE)

(72) Inventors: Stefan Niemeyer, Stelle (DE); Hendrik Sassenberg, Hamburg (DE)

(73) Assignee: Montblanc-Simplo GmbH (DE)

( * ) Notice: Subject to any disclaimer, the term of this patent is extended or adjusted under 35 U.S.C. 154(b) by 180 days.

(21) Appl. No.: 14/352,395

(22) PCT Filed: Oct. 19, 2012

(86) PCT No.: PCT/EP2012/070797

§ 371 (c)(1),
(2) Date: Apr. 17, 2014

(87) PCT Pub. No.: WO2013/057274

PCT Pub. Date: Apr. 25, 2013

(65) Prior Publication Data

US 2014/0241783 A1 Aug. 28, 2014

(30) Foreign Application Priority Data

Oct. 21, 2011 (DE) ..... 10 2011 116 762

(51) Int. Cl.
*B43K 5/16* (2006.01)
*B43K 1/01* (2006.01)
(Continued)

(52) U.S. Cl.
CPC ... *B43K 1/01* (2013.01); *B43K 5/06* (2013.01); *B43K 5/16* (2013.01); *B43K 5/189* (2013.01); *B43K 24/06* (2013.01)

(58) Field of Classification Search
CPC ..... B43K 5/16; B43K 24/06
USPC ..... 401/116
See application file for complete search history.

(56) References Cited

U.S. PATENT DOCUMENTS 6,186,687 B1 * 2/2001 Fuchs ..... B43K 5/16 401/116
6,409,405 B1 * 6/2002 Eddington ..... B43K 5/06 401/174
2008/0317541 A1 12/2008 Journe

FOREIGN PATENT DOCUMENTS

DE 335798 C 4/1921
DE 358672 C 9/1922
(Continued)

OTHER PUBLICATIONS

International Search Report for Application No. PCT/EP2012/070797 dated Jan. 25, 2013.

*Primary Examiner* — Jennifer C Chiang
(74) *Attorney, Agent, or Firm* — Lerner, David, Littenberg, Krumholz & Mentlik, LLP

(57) ABSTRACT

A writing implement may include a housing with an operating side and a writing side, a nib assembly longitudinally axially displaceably arranged in the housing with an ink reservoir and a piston longitudinally axially adjustably arranged therein, and an operating element, arranged on the operating side, which is rotatable and longitudinally axially displaceable into a first operating position and a second operating position. The operating element is mechanically connected to the nib assembly in the first operating position for the longitudinal axial displacement of the nib assembly and mechanically connected to the piston in the second operating position for the longitudinal axial adjustment of the piston.

13 Claims, 6 Drawing Sheets

(51) Int. Cl.

| | |
|---|---|
| ***B43K 24/06*** | (2006.01) |
| ***B43K 5/06*** | (2006.01) |
| ***B43K 5/18*** | (2006.01) |

(56) References Cited

FOREIGN PATENT DOCUMENTS

| | | | |
|---|---|---|---|
| DE | 368070 | C | 1/1923 |
| DE | 376257 | C | 5/1923 |
| DE | 446703 | C | 7/1927 |
| DE | 460971 | C | 6/1928 |
| DE | 591308 | C | 1/1934 |
| DE | 841277 | C | 6/1952 |
| DE | 19813153 | A1 | 10/1999 |
| DE | 102009019848 | A1 | 11/2010 |
| EP | 080627 | A1 | 6/1983 |
| FR | 888026 | A | 11/1943 |
| FR | 1103407 | A | 11/1955 |
| GB | 207904 | A | 12/1923 |
| WO | 0154919 | A1 | 8/2001 |

* cited by examiner

E-E:

WRITING IMPLEMENT

The present application is a national phase entry under 35 U.S.C. §371 of International Application No. PCT/EP2012/070797, filed Oct. 19, 2012, published in German, which claims priority from German Patent Application No. 10 2011 116 762.9, filed Oct. 21, 2011, all of which are incorporated herein by reference.

TECHNICAL FIELD

The invention relates to a writing implement and, in particular, a fountain pen.

BACKGROUND OF THE INVENTION

Fountain pens generally comprise a housing, an ink container arranged therein, an ink feed and a nib. The ink container may be in the form of a cartridge, a reservoir or a converter, the ink feed supplying the nib with ink from the ink container. At one operating end, fountain pens with a piston reservoir comprise an operating cone, which is rotatably mounted and connected to a spindle. The spindle, on its side opposing the operating cone, accommodates a piston, which is movably mounted in the piston reservoir so as to seal with an inner side of the piston reservoir. By moving the piston to a position located closest to the nib and the subsequent movement of the piston in the opposite direction, upon insertion of the nib into an inkwell, ink can be drawn into the piston reservoir. On conclusion of this process, the piston remains in its end position, while the piston reservoir gradually empties again during writing.

The system of the housing, operating cone arranged therein and a nib with a closure cap surrounding the nib comprises a certain minimum dimension according to the prior art. A fountain pen is therefore frequently only carried in relatively large pockets with a case provided for it.

SUMMARY OF THE INVENTION

A fountain pen could be carried more easily and, for example, also in a shirt or jacket pocket if it had smaller dimensions. However, the mechanism necessary for filling a piston reservoir stands in the way of this. More valuable fountain pens with particularly high quality workmanship are generally not equipped with converters or ink cartridges, so a piston reservoir with an operating cone cannot necessarily be dispensed with to make the fountain pen compact.

It may therefore be considered an object of the invention to propose a writing implement having as compact a form as possible without dispensing with the use of a piston reservoir.

The object is met by a writing implement having the features of the independent claim 1. Advantageous embodiments and further improvements may be inferred from the subordinate claims and the following description.

In an advantageous embodiment, the writing implement comprises a housing with an operating side and a writing side, a nib assembly longitudinally axially displaceably arranged in the housing with an ink reservoir and a piston arranged longitudinally axially adjustably therein and an operating element, arranged on the operating side, which is rotatable and longitudinally axially displaceable into a first operating position and a second operating position. The operating element is mechanically connected to the nib assembly in the first operating position for the longitudinal axial displacement of the nib assembly. The operating element is mechanically connected to the piston in the second operating position for the longitudinal axial adjustment of the piston.

The writing implement comprises an elongate form, which is characterised by a longitudinal axis. The term "longitudinally axially" refers to a direction running along the longitudinal axis or parallel thereto. The nib assembly is a unit consisting of a nib, an ink feed and an ink reservoir. The writing side of the housing is the side facing the paper during writing, while the operating side is the side of the housing opposing this. The operating element is a mechanical component, which is operatable from the operating side of the housing and, depending on the operating position, produces a mechanical engagement either with an adjusting mechanism to displace the nib assembly or with an adjusting mechanism to move the piston. The nib assembly is, in this case, to be regarded as a unit, which is necessary to write with the fountain pen and comprises at least an ink feed with a nib arranged thereon and an ink reservoir with a piston arranged therein in addition to an adjusting mechanism for the piston.

The housing is the part of the writing implement, which is touched by the operator when writing and filling the ink reservoir and is the outermost shell of the writing implement. Accommodated in the housing are all the necessary mechanisms, which allow a continuous ink flow to a nib. The longitudinally axially displaceable nib assembly is accommodated in the housing of the writing implement according to the invention. This means that the nib assembly is movable within the housing so the nib projects more or less from the writing side of the housing to reduce or increase the length of the writing implement. This longitudinal axial displaceability may preferably be dimensioned in such a way that the nib assembly can be drawn completely into the housing, so the nib of the nib assembly has completely disappeared on the writing side. A clearly more compact configuration of the writing implement may thus be achieved. The ink reservoir and the housing are to be dimensioned such that the ink reservoir does not lead to mechanical interferences with the operating element or a mechanism arranged therein when the nib assembly is retracted.

The writing implement according to the invention may provide two different functions due to this structure with the operating element. The first function lies in the longitudinal axial displacement of the nib assembly, while the second function lies in the movement of the piston of the ink reservoir. In order to be able to carry out the two functions selectively, it is necessary to bring the operating element into a first operating mode and into a second operating mode. The first operating mode may, for example, be achieved in that the operating element is arranged in a first operating position so a mechanical connection to the nib assembly or an adjusting mechanism connected thereto takes place so the nib assembly may be longitudinally axially displaced by rotating the operating element. The second function, namely the operation of the piston, may be initiated by moving the operating element into a second operating position. The operating element may be withdrawn for this purpose from the housing on the operating side of said housing, similarly to a watch crown for adjusting the time. Owing to the movement of the operating element into the second operating position, a mechanical connection between the operating element and the piston or an adjusting mechanism connected thereto may take place to move the latter within the ink reservoir in a longitudinal axial direction. The writing implement according to the invention may accordingly, without dispensing with a conventional piston reservoir, by retracting the nib assembly, have a clearly more compact configuration than is the case in conventional piston fountain pens.

In an advantageous embodiment of the invention, the nib assembly may comprise a first adjusting means which, in the first operating position, forms a first adjusting drive with a first drive means. This converts a rotation of the first drive means into a longitudinal axial movement of the nib assembly, the first drive means being non-rotatably connectable to the operating element. The first adjusting means and the first drive means may, for example, be configured as mechanical components that interact with one another in pairs and allow a conversion of a rotation into a longitudinal axial movement. A section, along which a connection of the operating element to the first drive means may be produced or severed, is created by the displacement of the operating element between two operating positions longitudinally axially spaced apart. At least in the first operating position, the first drive means is non-rotatably connected to the operating element so a rotation of the operating element exclusively leads to the rotation of the first drive means, which in turn leads to a longitudinal axial displacement of the nib assembly owing to the cooperation with the first adjusting means.

In an advantageous embodiment, the piston furthermore comprises a second adjusting means which, in the second operating position, forms a second adjusting drive with a second drive means. This converts a rotation of the second drive means into a longitudinal axial movement of the piston, the second drive means being non-rotatably connectable to the operating element, at least in the second operating position. Accordingly, the mechanical connection to the first drive means is released in the second operating position and the rotation of the operating element exclusively leads to a movement of the second drive means, which initiates a movement of the piston in the reservoir.

In an advantageous embodiment, the first adjusting means is in the form of a rotatably mounted adjusting bushing with a cam track formed therein, in which engagement means engage. The adjusting bushing comprises a second gear ring, which may be brought into engagement with a first gear ring non-rotatably connected to the operating element. The first and the second gear ring are dimensioned in such a way that they only form an engagement in the first operating position and are accordingly released on the section between the first and the second operating position. A cam track, in this context, is to be taken to mean a radial milling in the rotatably mounted adjusting bushing, which is configured in such a way that non-rotatably configured but longitudinally axially displaceable engagement means would carry out an axial movement in the cam track when the adjusting bushing rotates. The cam track is accordingly mechanically comparable with a thread having an extremely large pitch. The first drive means comprises a first gear ring, which, for example, consists of a uniform arrangement of teeth distributed on a periphery that may be brought into engagement with a correspondingly configured second gear ring. The heights of the teeth of these two gear rings are furthermore dimensioned in such a way that they are smaller than the spacing between the first operating position and the second operating position of the operating element so the mechanical connection between the first gear ring and the second gear ring is severed as soon as the operating element is brought from the first operating position into the second operating position.

In an advantageous embodiment, the first gear ring is arranged on a gear ring body, the gear ring body being non-rotatably connected to the operating element and displaceably mounted in the longitudinal axial direction on the operating element. The engagement between the first gear ring and the second gear ring may therefore tolerate an imprecise orientation of the first gear ring and the second gear ring in relation to one another so damage to the gear rings may be avoided.

An equally advantageous embodiment also comprises a spring, which is set up to press the gear ring body into a position remote from the operating side. Thus, with a correct orientation of the gear rings in relation to one another, an aligned engagement may be brought about by cushioning the gear ring body.

In an advantageous embodiment of the invention, the second drive means is in the form of a first rotatably mounted spindle body with a radial tooth system arranged on an outer side, the second adjusting means being in the form of a longitudinally axially displaceable second spindle body, which is connected to the piston and is engaged with the first spindle body. The radial tooth system of the first spindle body may be brought into engagement with a drive tooth system on the operating element. The radial tooth system is arranged on the first spindle body in such a way that the drive tooth system only forms an engagement with the radial tooth system in the second operating position. The radial tooth system could, for example, be arranged on an outer side, i.e. on a peripheral face of the first rotatably mounted spindle body, the drive tooth system being displaced by a longitudinal axial movement of the operating element with respect to the first rotatably mounted spindle body in such a way that the teeth of the drive tooth system project into the intermediate spaces of the radial tooth system of the first rotatably mounted spindle body. The length of the teeth on the first spindle body and on the drive tooth system could accordingly preferably be below the length of the section between the first and the second operating position of the operating element.

In an advantageous embodiment of the invention, a guide portion of the operating part is axially displaceably arranged in a part of the writing implement that is fixed to the housing. Arranged between an inner side of the part that is fixed to the housing and an outer side of the guide portion is a latching device, which is set up to releasably latch the guide portion in two positions spaced apart from one another in the longitudinal axial direction. The latching device may be realised by any means, in which, for example, a deformable or compressible latching element rests on a holding face and may be released again from this position by the action of a force by deformation or compression. This latching element may be configured as a metal sheet or ring, which may be produced from a plastics material or a metal. The operating part may be retained in a first and in a second operating position by a releasable latching connection in order to only leave this position again by the action of a force.

The guide portion of the operating part is preferably axially displaceably arranged in a part of the writing implement that is fixed to the housing, an inner side of the part that is fixed to the housing and an outer side of the guide portion having three annular grooves, of which either the part that is fixed to the housing or the guide portion accommodates two annular grooves spaced apart from one another in the longitudinal axial direction and wherein a latching element, which may be brought resiliently releasably into the annular groove not accommodating a respective latching element, at least in regions, is arranged in at least one annular groove. Owing to the resilient projection of the latching element from an annular groove into an aligned annular groove, a releasable connection may easily be achieved, which is permanently reliable.

In an advantageous embodiment of the invention, the latching element is a holding ring made of a resilient material, which is arranged in the annular groove of the part that is fixed to the housing and comprises at least one region, the local diameter of which falls below the diameter of the annular grooves of the operating part. This region may, for example, have the form of a flattened area or the holding ring may in general comprise an elliptical or other configuration deviating from a circular form. The holding ring may be pressed radially outwardly into its annular groove accommodating it by the action of a force in such a way that a free movement of the guide portion is allowed.

In an alternative embodiment, arranged in each annular groove of the operating part is a latching element in the form of a holding ring made of a resilient material, which comprises a discontinuation and the mean diameter of which exceeds the diameter of the annular groove accommodating it in the unloaded state. As a result, an expansion of the holding ring is caused radially outwardly by the operating part or its guide portion so upon an alignment of two annular grooves, a releasable connection is produced. By the action of a force, the holding ring is compressed, so its discontinuation is made smaller and the mean diameter of the holding ring is reduced. Consequently an immersion of the holding ring radially inwardly in the annular groove accommodating it is brought about so the guide portion may move again freely.

In an advantageous embodiment, the guide portion or the part that is fixed to the housing comprises at least one step, which is arranged at least adjacent to an inner annular groove of the guide portion. In addition to this, a step may also be arranged adjacent to the outer one of the two annular grooves that are spaced apart from one another. This is used to provide a mechanical stop, at least in the second operating position, in order to rule out possible incorrect operations or incorrect functions of the operating element. Furthermore, the inner step ensures that the operating element cannot be completely withdrawn from the writing implement and become lost.

In an advantageous embodiment, the writing implement comprises a linear guide for the anti-twist guidance of the nib assembly within the housing which, for example, may be made in the form of an elongate slot, in which a sliding body or an axle may be displaced. As a result, a reliable and precise adjustment of the nib assembly may be achieved and the nib assembly may also not rotate when writing.

In an equally advantageous embodiment, the operating element projects outwardly from the operating side of the housing and is supplemented by a cone.

BRIEF DESCRIPTION OF THE DRAWINGS

Further features, advantages and application possibilities of the invention emerge from the following description of the embodiments and the figures. In this case, all the described and/or graphically shown features per se and any desired combination also form the subject-matter of the invention independently of their combination in the individual claims or their references back. Furthermore, the same reference numerals stand for the same or similar objects in the figures.

DETAILED DESCRIPTION OF EXEMPLARY EMBODIMENTS

Figure 1A:
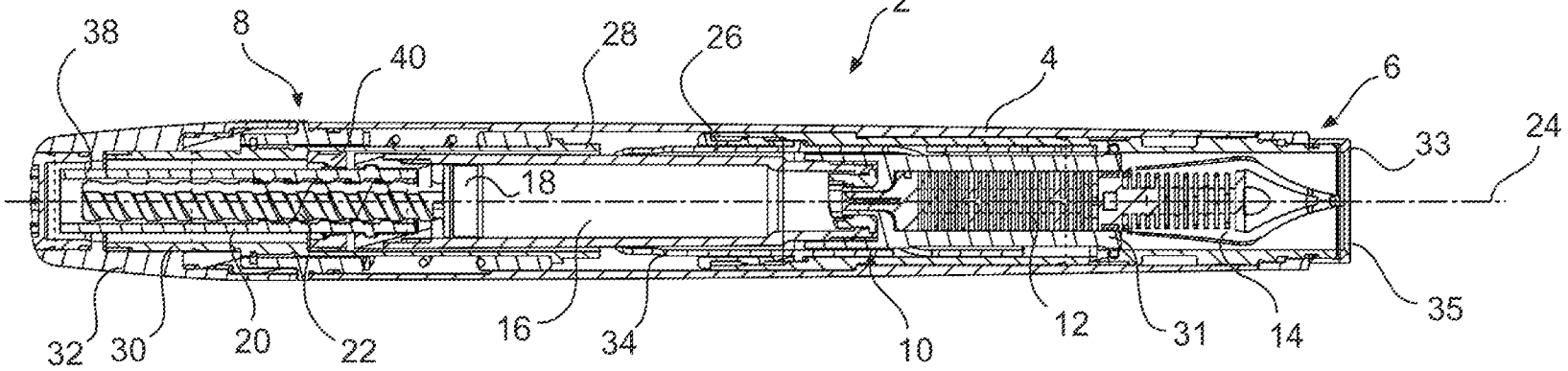
FIGS. 1*a*, 1*b*, 1*c* and 1*d* show the writing implement according to the invention in different operating states, in each case in a lateral section.

FIG. 1*a* shows a writing implement 2 according to the invention in a lateral sectional view. A tube-like housing 4 comprises a writing side 6 and an operating side 8. Arranged within the housing 4 is a nib assembly 10, which consists of an ink feed 12 with a nib 14 arranged thereon, an ink reservoir 16 with a piston 18 arranged therein as well as a spindle mechanism with a first spindle body 20 and a second spindle body 22. The nib assembly 10 may be displaced along a longitudinal axis 24 of the writing implement 2 within the housing 4, the nib assembly 10 being inserted in the housing 4 in FIG. 1*a* in such a way that the nib 14 is completely accommodated in the housing 4.

The nib assembly 10 comprises, for displacement, a rotatably mounted adjusting bushing 26 as a first adjusting means, which may be brought into engagement with a first drive means 28. Both the first drive means 28 and the second drive means in the form of the first spindle body 20, depending on the operating position, may be driven by an operating element 30, which extends from the operating side 8 into the housing 4 and comprises an operating cone 32.

In FIG. 1*a*, the operating element 30 is shown in the first operating position, in which the operating cone 32 is arranged at least substantially aligned on the housing 4. By rotating the operating cone 32, the adjusting bushing 26 is driven by means of the first drive means 28 with a first gear ring 54 arranged thereon (not visible in this view, see FIGS. 2*a* and 2*b*), which is brought into engagement with a second gear ring 34. The nib assembly 10 consequently carries out a movement along the longitudinal axis 24 by means of engagement means 62 arranged thereon (not visible in this view, see FIG. 3*b*) via a cam track 36 configured in a spiral shape, at least in portions.

Figure 1B:
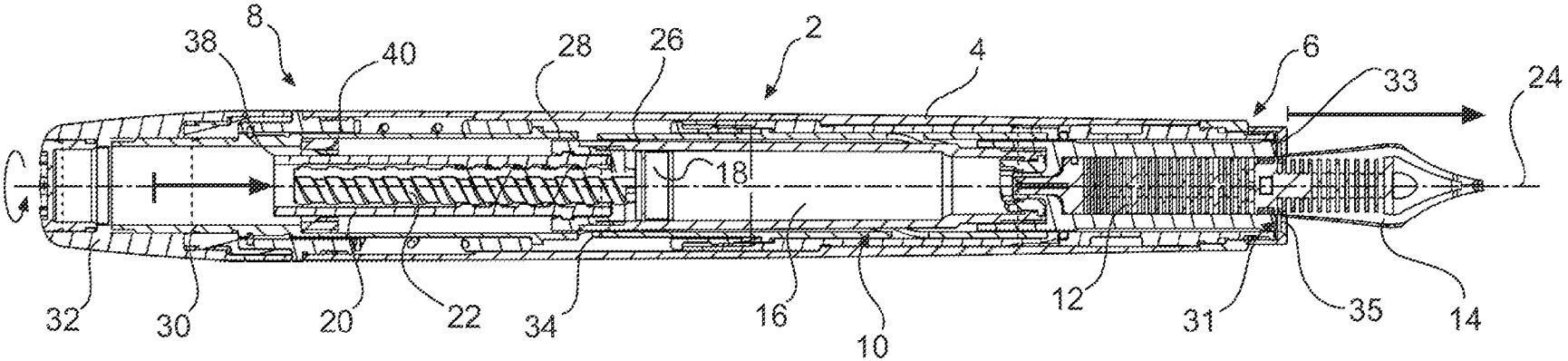

FIG. 1*b* shows the state of the writing implement 2 once the operating cone 32 has been rotated in the first operating position, so the nib assembly 10 is present in a maximally extended position. A stop of the nib assembly 10 is produced by the end of the cam track 36 of the adjusting bushing 26. A termination of the shoulder 33 and a housing opening 35 is used for sealing and locks the nib assembly 10 laterally in a writing position, while a front edge 31 in this case approaches the shoulder 33 of the housing opening 35 on the writing side 6 in an aligned manner. In comparison to FIGS. 1*a* and 1*b* it becomes clear that the entire nib assembly 10 with the reservoir 16, the piston 18 and the adjusting mechanism 20, 22 arranged thereon is displaced within the housing in the longitudinal direction parallel to the longitudinal axis 24. After this step has been carried out, the writing implement 2 may be used for writing. To prevent automatic rotation back occurring, the cam track 36 comprises a plateau in the end position provided.

Figure 1C:
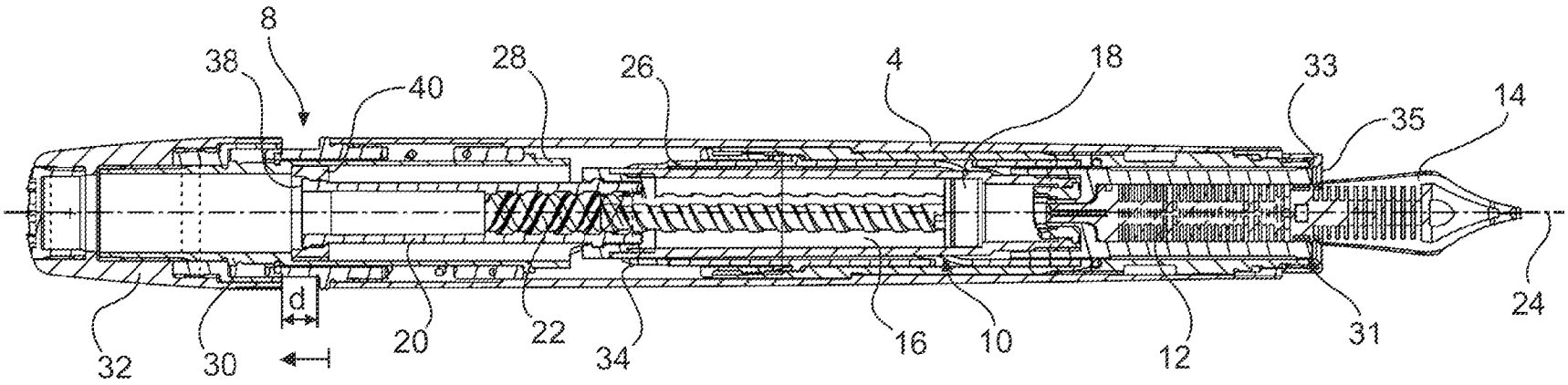

FIG. 1*c* shows that the operating cone 32, and therefore the operating element 30, may be withdrawn from the housing 4 by a section d in order to release the mechanical connection between the first gear ring 54 and the second gear ring 34 and instead to bring about a mechanical connection between a radial tooth system 38 on the outer side of the first spindle body 20 and a drive tooth system 40 on an inner side of the tube-like portion of the operating element 30. By rotating the operating cone 32, the first spindle body 20 may correspondingly be rotated so the piston 18 is moved in the reservoir 16. The spacing of the radial tooth system 38 and the drive tooth system 40 in relation to one another in the writing position, in which the operating cone 32 is not withdrawn, and a desired overlap amount produces a necessary section d, by which the operating cone 32 has to be withdrawn from the housing 4.

Figure 1D:
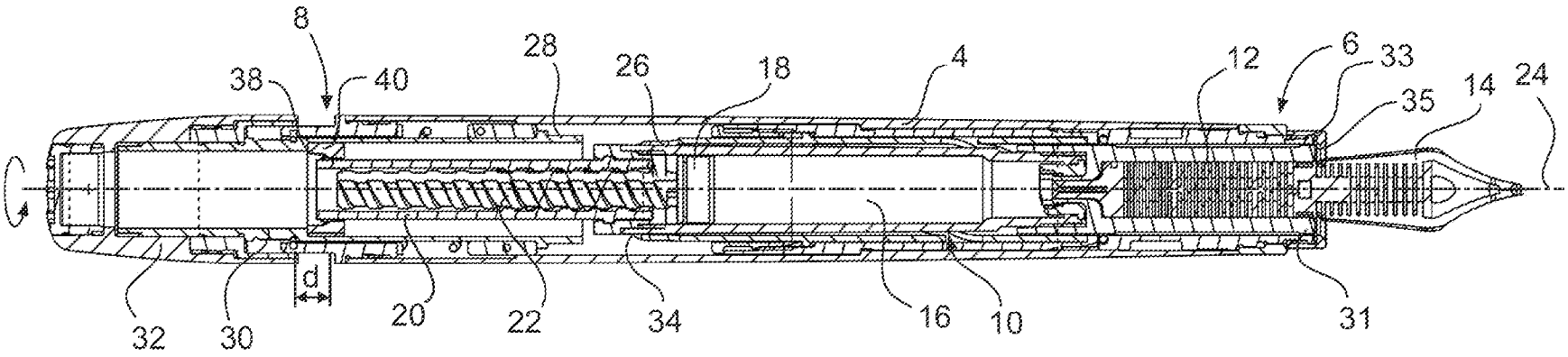

While FIG. 1*c* shows the piston 18 in a position next to the nib 14, FIG. 1*d* shows the piston 18 in a position remote from the nib 14. When viewed together with FIGS. 1*a* and 1*b* it becomes clear that the piston 18 may only be moved when the nib 14 is moved out of the housing 4. This is sensible, as the ink reservoir 16 may only be filled by immersing the nib in an inkwell or the like.

Figure 2A:
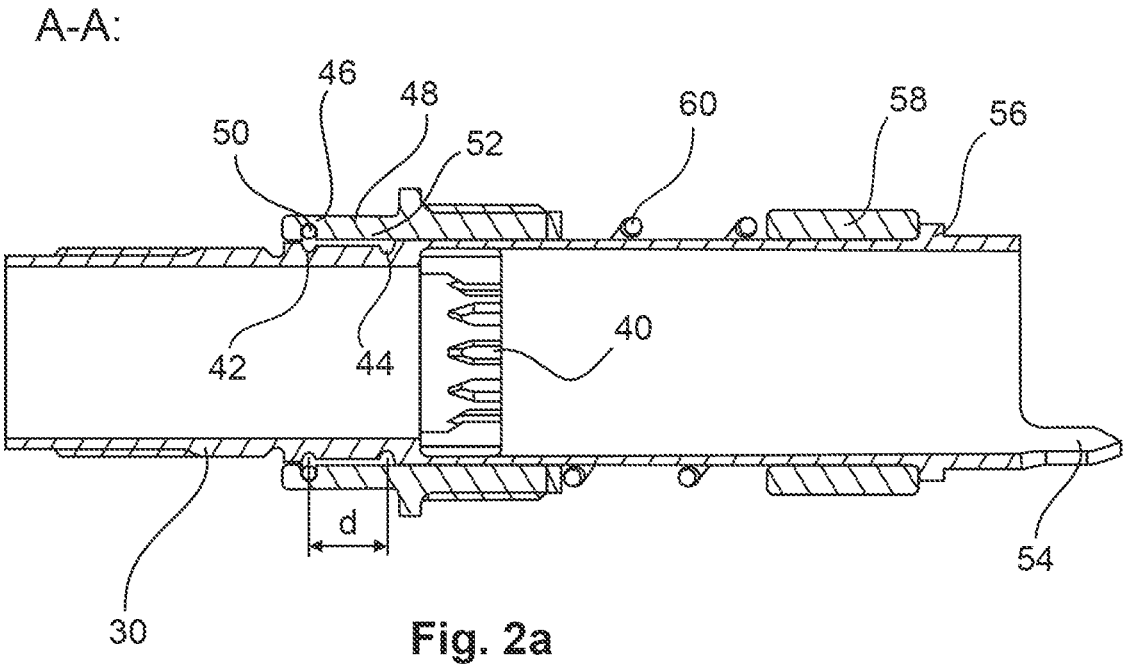
FIGS. 2*a* and 2*b* show a part of the operating element and its arrangement in a part of the writing implement that is fixed to the housing in a lateral section and in a lateral view.
Figure 2B:
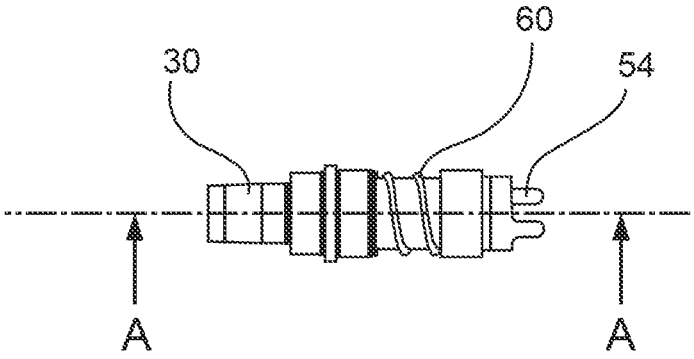

FIG. 2*a* shows in slightly more detail that, by way of example, the operating element 30 comprises a latching device in the form of an arrangement of two annular grooves 42 and 44, which are spaced apart from one another and may be made to align with an annular groove 46 of a part 48 that is fixed to the housing. Arranged in the annular groove 46 of the part 48 that is fixed to the housing is a holding ring 50, which preferably consists of a deformable resilient material, which comprises at least one region, in which the mean diameter slightly falls below the diameter of the annular groove 46. This may be seen from the lower side of the groove 46 in the plane of the drawing. If one of the two annular grooves 42 or 44 aligns with the annular groove 46 of the part 48 that is fixed to the housing, a releasable positive connection exists as the at least one region of the holding ring 50 with a smaller diameter than the annular groove 46 extends into one of the two annular grooves 42 or 44 of the operating element 32. By means of the action of a certain force, the at least one region with a smaller diameter may immerse, because of the resilient properties of the holding ring 50, in the annular groove 46 receiving it of the part 48 that is fixed to the housing so the latching connection is released. As a result, the operating part 30 with a guide portion 52 may slip within the part 48 that is fixed to the housing by the section length d until the respective other annular groove 42 or 44 comes to align with the holding ring 50 and the latter comes to engage there after elastic recovery.

As an alternative to this for a latching device of this type, the part 48 that is fixed to the housing may also comprise two annular grooves 42 and 44 adjacent to one another, while the guide portion 52 of the operating part 30 only accommodates the individual annular groove 46. The holding ring 50 would then be arranged in the annular groove 46 of the guide portion and could extend upon alignment in the outer annular grooves 42 and 44. For this purpose, the holding ring 50 is preferably slotted or discontinued in another manner and comprises a mean diameter, which exceeds the diameter of the annular groove 46 receiving it. Upon alignment of the annular grooves 42, 46 or 44, 46, a releasable latching connection would be produced. By means of the action of a force, the holding ring 50 could be compressed, to then leave the outer annular grooves 42 and 44 and again be immersed radially inwardly in the annular groove 46.

The first gear ring 54 is indicated at one end of the operating element 30 and may be brought into engagement with the second gear ring 34 on the adjusting bushing 26. A step 56, which may rest on a ring 58, which is mounted on the operating element 30 and may slide on the inner face of the housing, adjoins the first gear ring 54. A spring 60 may be arranged between the part 48 that is fixed to the housing and the ring 58 to bring about protection against rattling and also to ensure a securing of position of the tooth system 54.

A drive tooth system 40, which may be brought into engagement with the radial tooth system 38 of the first spindle body 20, is shown on an inner side of the operating element 30. As stated above, a necessary section length d, by which the operating cone 32 has to be withdrawable from the housing 4, is produced from the spacing of the radial tooth system 38 and the drive tooth system 40 in relation to one another in the writing position, in which the operating cone 32 is not withdrawn, and a desired overlap amount. When the operating element 30 is pressed in by the section length d, a meshing between the drive tooth system 40 and the radial tooth system 38 of the first spindle element 20 is accordingly released.

Figure 3A:
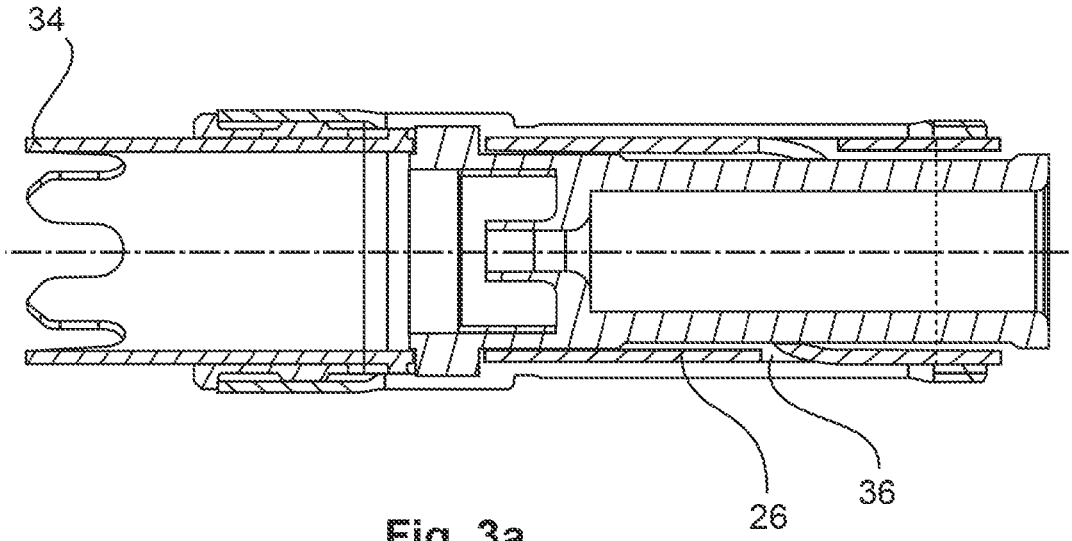
FIGS. 3*a* and 3*b* show the first adjusting mechanism for the longitudinal axial adjustment of the nib assembly in a lateral section and in a lateral view.

FIG. 3*a*, in a lateral section, shows the second gear ring 34, which is connected to the cam track 36 of the adjusting bushing 26 in such a way that the adjusting bushing 26 is rotated by the engagement of the first gear ring 54. The cam track 36 is to be designed in such a way that the nib assembly 10 may be displaced as smoothly as possible at an angle of rotation that may be initiated without grasping the operating cone 32.

Figure 3B:
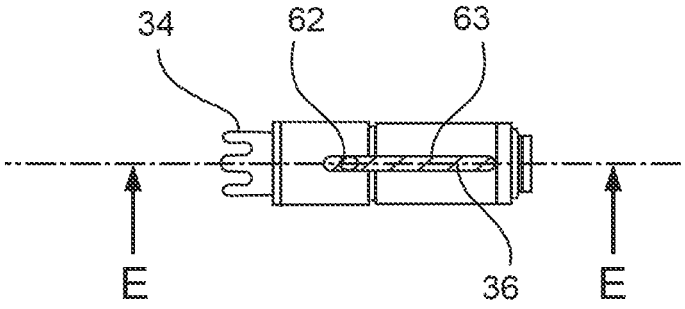

As may be seen from FIG. 3*b*, engagement means 62 projecting from the nib assembly 10 into the cam track 36 may be arranged on the nib assembly 10 to allow an axial movement of the nib assembly 10. The nib assembly 10 should accordingly preferably be non-rotatably mounted so the engagement means 62 may only be moved linearly. An anti-twist device possible for this is shown by way of example in the form of two longitudinal grooves 63, which extend parallel to the longitudinal axis 24 and are set up to receive a sliding body arranged on the nib assembly 10, an axle, a pin or the like.

Figure 4A:
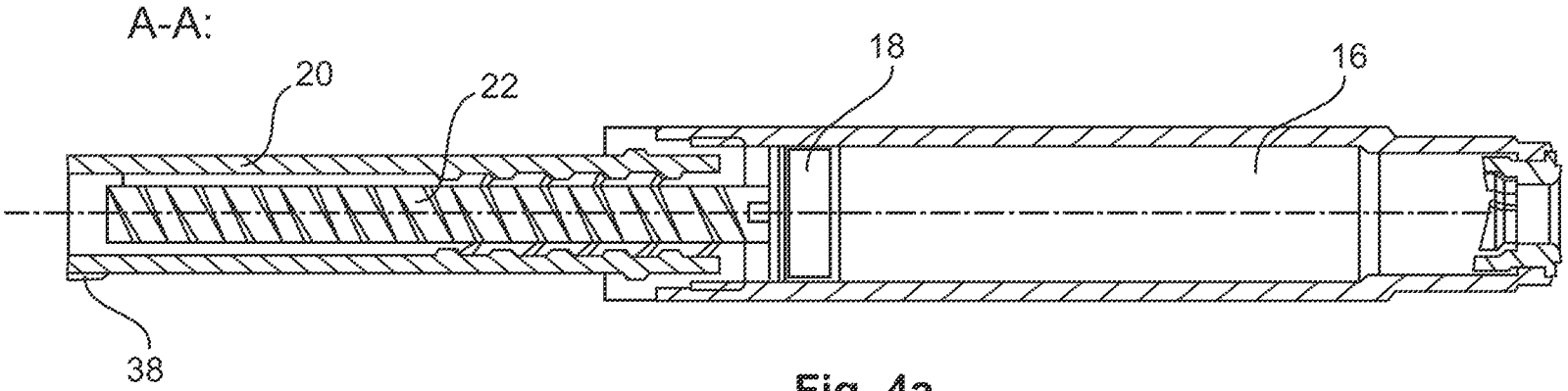
FIGS. 4*a* and 4*b* show the second adjusting mechanism to adjust the piston in the reservoir with a lateral sectional view and with a lateral view.
Figure 4B:
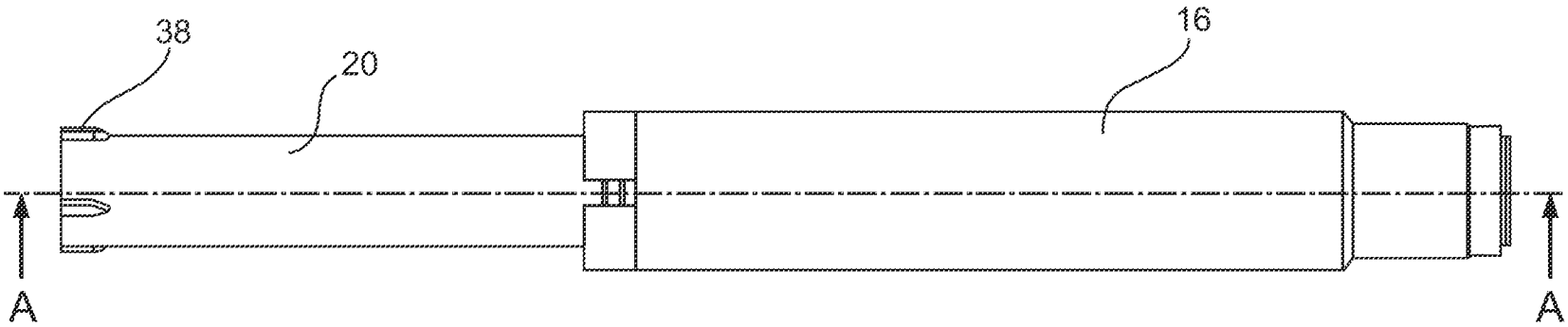

FIGS. 4*a* and 4*b* show the adjusting mechanism for moving the piston 18 in the ink reservoir 16, the piston 18 being connected to the second spindle body 22, which is engaged with the first spindle body 20. The latter comprises a radial tooth system 38, the teeth of which preferably extend longitudinally axially on the outer side of the first spindle body 20. Owing to the drive system 40 configured corresponding thereto on the operating element 30, an engagement may be produced in the second operating position that leads to the rotation of the first spindle body 20. A movement of the piston 18 within the reservoir 16 may be initiated by a preferably non-rotatably mounted spindle arrangement with a second spindle body 22 and the piston 18.

Figure 5:
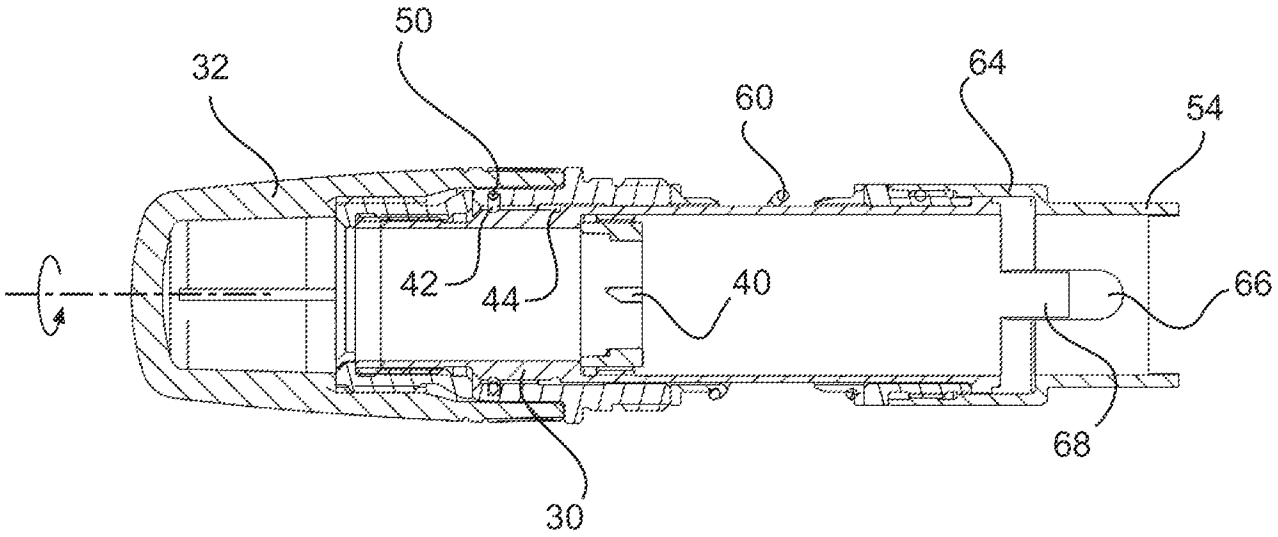
FIG. 5 shows a modification with a first gear ring that may be displaced in the longitudinal axial direction.

FIG. 5 shows a slight modification of the configuration of the operating element 30 and the first gear ring 54 arranged thereon. The first gear ring 54 is configured here on an annular gear ring body 64, which is configured separately from the operating element 30, and is displaceably arranged in the longitudinal direction on the operating element 30. A non-rotatable connection between the gear ring body 64 and the operating element 30 is produced by a groove 66, which is arranged peripherally and in which a guide element 68 arranged peripherally on the operating element 30 engages. By means of the spring 60, which is already inserted in FIG. 2*b*, the gear ring body 64 is constantly urged into an outermost position having the greatest possible spacing from the operating cone 32.

If, after the filling of the ink reservoir 16, the operating cone 32 is pressed from the second operating position into the first operating position, it may be the case that, depending on the rotational movement of the operating cone 32 carried out, the tooth system of the first gear ring 54 does not completely align with the tooth system of the second gear ring 34. The individual teeth could lie slightly on top of one another without engaging in one another. The spring 60, in the embodiment shown in FIG. 5, in this case allows the gear ring body 64 to resiliently spring back here so once the operating cone 32 starts rotating, the first gear ring 54 and the second gear ring 34 come into alignment so the gear ring body 64 snaps into its outermost position owing to the spring pressure and engages the tooth system. Damage to the adjusting mechanism may thus be prevented.

Owing to the combination of two functions, which may be operated with the aid of a single operating element, a clearly more compact configuration of a fountain pen may be implemented because of the movable nib assembly than is currently conventional in the prior art. The use of a reservoir with a piston arranged therein is nevertheless not ruled out. A fountain pen configured in this manner may be made more compact after use, in that the nib assembly, and therefore the nib, are retracted into the housing, whereupon a cap is to be placed on the writing side. The longitudinal extent of the fountain pen is therefore very compact.

It should additionally be pointed out that "having" does not exclude any other elements or steps and "a" does not exclude the plural. Furthermore, it is pointed out that features that have been described with reference to one of the above embodiments may also be used in combinations with other features of other embodiments described above. Reference numerals in the claims are not to be regarded as restrictions.

The invention claimed is:

1. A writing implement, comprising:

a housing with an operating side and a writing side, a nib assembly longitudinally axially displaceably arranged in the housing with an ink reservoir and a piston longitudinally axially adjustably arranged therein, and an operating element, arranged on the operating side, which is rotatable and longitudinally axially displaceable into a first operating position and a second operating position, wherein the operating element is mechanically connected to the nib assembly in the first operating position for the longitudinal axial displacement of the nib assembly, and wherein the operating element is mechanically connected to the piston in the second operating position for the longitudinal axial adjustment of the piston.

2. The writing implement according to claim 1, wherein the nib assembly comprises a first adjusting means which, in the first operating position, with a first drive means, forms a first adjusting drive, which converts a rotation of the first drive means into a longitudinal axial movement of the nib assembly, the first drive means being non-rotatably connectable to the operating element.

3. The writing implement according to claim 1, wherein the piston comprises a second adjusting means which, in the second operating position, with a second drive means, forms a second adjusting drive, which converts a rotation of the second drive means into a longitudinal axial movement of the piston, the second drive means being non-rotatably connectable to the operating element.

4. The writing implement according to claim 2, wherein the first adjusting means is in the form of a rotatably mounted adjusting bushing with a cam track formed therein, in which engagement means engage, the adjusting bushing having a second gear ring, which is engageable with a first gear ring non-rotatably connected to the operating element, the first gear ring and the second gear ring being dimensioned in such a way that they only form an engagement in the first operating position.

5. The writing implement according to claim 4, wherein the first gear ring is arranged on a gear ring body, the gear ring body being non-rotatably connected to the operating element and being displaceably mounted in the longitudinal axial direction on the operating element.

6. The writing implement according to claim 5, further having a spring, which is set up to press the gear ring body into a position remote from the operating side.

7. The writing implement according to claim 3, wherein the second drive means is in the form of a first rotatably mounted spindle body with a radial tooth system arranged on an outer side, the second adjusting means being in the form of a longitudinally axially displaceable second spindle body, which is connected to the piston and is engaged with the first spindle body, the radial tooth system of the first spindle body being able to be brought into engagement with a drive tooth system on the operating element, the radial tooth system being arranged on the first spindle body in such a way that the drive tooth system only forms an engagement with the radial tooth system in the second operating position.

8. The writing implement according to claim 1, wherein a guide portion of the operating part is axially displaceably arranged in a part of the writing implement that is fixed to the housing, an inner side of the part that is fixed to the housing and an outer side of the guide portion having three annular grooves, of which either the part that is fixed to the housing or the guide portion accommodates two annular grooves spaced apart from one another in the longitudinal axial direction, and a latching element, which is resiliently releasably introducable, at least in regions, into the respective annular groove not accommodating a latching element, being arranged in at least one annular groove.

9. The writing implement according to claim 8, wherein the latching element is a holding ring made of a resilient material, which is arranged in the annular groove of the part that is fixed to the housing and comprises at least one region, the local diameter of which falls below the diameter of the annular grooves of the operating part.

10. The writing implement according to claim 8, wherein arranged in each annular groove of the operating part is a latching element in the form of a holding ring made of a resilient material, which comprises a discontinuation and the mean diameter of which exceeds the diameter of the annular groove accommodating it in the unloaded state.

11. The writing implement according to claim 8, wherein the guide portion or the part that is fixed to the housing comprises at least one step, which is arranged at least adjacent to an inner annular groove of the guide portion.

12. The writing implement according to claim 1, further having a linear guide for the anti-twist guidance of the nib assembly within the housing.

13. The writing implement according to claim 1, wherein the operating element comprises an operating cone.

* * * * *